United States Patent [19]

Haugsjaa et al.

[11] 3,997,816

[45] Dec. 14, 1976

[54] STARTING ASSIST DEVICE FOR AN ELECTRODELESS LIGHT SOURCE

[75] Inventors: Paul Osborne Haugsjaa, Acton; William Henry McNeill, Carlisle; Robert James Regan, Needham, all of Mass.

[73] Assignee: GTE Laboratories Incorporated, Waltham, Mass.

[22] Filed: Apr. 21, 1975

[21] Appl. No.: 570,108

[52] U.S. Cl. ..... 315/267; 315/327; 315/331; 313/146; 313/198

[51] Int. Cl.[2] ..... H05B 41/24

[58] Field of Search ..... 315/55, 105, 39, 248, 315/267, 327, 330, 331; 313/100, 146, 198

[56] References Cited

UNITED STATES PATENTS

| | | | |
|---|---|---|---|
| 3,138,739 | 6/1967 | Farmer | 315/248 |
| 3,141,111 | 7/1964 | Godlove | 315/151 |
| 3,227,923 | 1/1966 | Marrison | 315/248 |
| 3,350,602 | 10/1967 | Germeshausen et al. | 315/150 |
| 3,787,705 | 1/1974 | Bolin | 315/267 |
| 3,790,852 | 2/1974 | Bolin | 315/267 |
| 3,826,950 | 7/1974 | Hruda | 315/267 |

FOREIGN PATENTS OR APPLICATIONS

| | | | |
|---|---|---|---|
| 1,237,009 | 6/1971 | United Kingdom | 315/248 |

*Primary Examiner*—John Kominski
*Attorney, Agent, or Firm*—Irving M. Kriegsman; Leslie J. Hart

[57] ABSTRACT

An electrodeless lamp is excited by high frequency power in a termination fixture having an inner and an outer conductor, the lamp being located in the high field region at the end of the conductors. A source of ultraviolet radiation is located near the lamp and is activated momentarily when the lamp is to be excited. The radiation assists in initiating breakdown and excitation of the fill material in the lamp.

8 Claims, 5 Drawing Figures

STARTING ASSIST DEVICE FOR AN ELECTRODELESS LIGHT SOURCE

BACKGROUND OF THE INVENTION

The present invention relates to electrodeless light sources and, more particularly, to such sources which are excited by high frequency power, such as in the range of 100 MHz to 300 GHz.

There have been, historically, three basic methods of exciting discharges without electrodes. The first method uses the discharge as a lossy part of either the capacitance or inductance of a "tank" circuit. This method is used to advantage only at frequencies where the dimensions of the lamp are much smaller than the wavelength of excitation. Also, in this method, there are power losses due to radiation and shifts in frequency upon start-up. A second method of exciting electrodeless lamps with microwave power is to place the lamp in the path of radiation from a directional antenna. However, since free propagation of microwave power occurs, there is an inherent inefficiency and some of the power is scattered thereby endangering persons in the area.

A third method uses a resonant cavity which contains the lamp, a frequency tuning stub and a device for matching the lamp cavity impedance to that of the source and transmission line. Examples of devices according to this method may be found in "Microwave Discharge Cavities Operating at 2450 MHz" by F. C. Fehsenfeld et al., Review of Scientific Instruments, Volume 36, Number 3, (March, 1965). This publication describes several types of tunable cavities. In one type, cavity No. 5, the discharge cavity transfers power from the source to the lamp, and the resonant structure of the cavity increases the electric field in the gas of the lamp. The presence of a discharge in the resonator changes the resonant frequency and also changes the loaded Q factor. Therefore, it is necessary to provide both tuning (frequency) and matching (impedance) adjustments to obtain efficient operation over a wide range of discharge conditions. The tuning stud is first adjusted for a minimum reflected power with the minimum probe penetration. Next, the probe (impedance) is adjusted. Since these two operations are not independent, successive readjustments are required to achieve optimum efficiency.

All of these tunable cavities have features which make them less than ideally suited for use in an electrodeless light source. To make cavity type systems useful economically, the cavity must be small enough so that it would be feasible to use such systems in place of the conventional electrodecontaining lamp. Resonant cavities are too large and must be larger if lower microwave frequencies are used. One resonant cavity for 2450 MHz operation has 4 inches as its greatest dimension; the size would be even larger for operation at 915 MHz which is a standard microwave frequency for consumer use, such as with microwave ovens. Operation at this lower frequency is also advantageous from the view that the greater the frequency the more expensive the microwave power source becomes. The known tunable cavity has a less than optimum shape because the lamp is substantially enclosed by the resonant cavity housing, thereby impeding the transmission of light.

SUMMARY OF THE INVENTION

It is an object of the present invention to provide an electrodeless light source having an improved starting assist device.

It is another object of the present invention to provide a starting assist device which may be powered from the same source that powers the primary light source.

It is an additional object to provide a light source in which the starting device is located internally to a termination fixture for an electrodeless light source thereby not detracting from the appearance of the source.

According to the present invention, an improved light source includes an electrodeless lamp, a termination fixture having an inner and outer conductor for coupling high frequency power to the lamp and a source of ultraviolet light to assist in initiating breakdown of the fill material in the electrodeless lamp. The ultraviolet source may be a low pressure mercury discharge or an air discharge near the lamp which is momentarily present only to cause the lamp to break down.

Preferably, the ultraviolet light source is connected across the conductors so that it may be powered by the high frequency power source. In addition, the UV source is preferably located in the region between the conductors, thereby providing a light source which is compact and uniform in shape.

In one preferred form of the invention, the UV source is an air discharge created by a spring wire affixed to the outer conductor and a non-conducting probe operably associated with the wire such that by moving the probe which protrudes through the outer conductor, the wire may be made to contact the inner conductor. When the contact terminates, a spark is produced across the gap, thereby producing UV radiation which initiates breakdown of the fill material of the electrodeless lamp.

DESCRIPTION OF THE PREFERRED EMBODIMENTS

Figure 1:
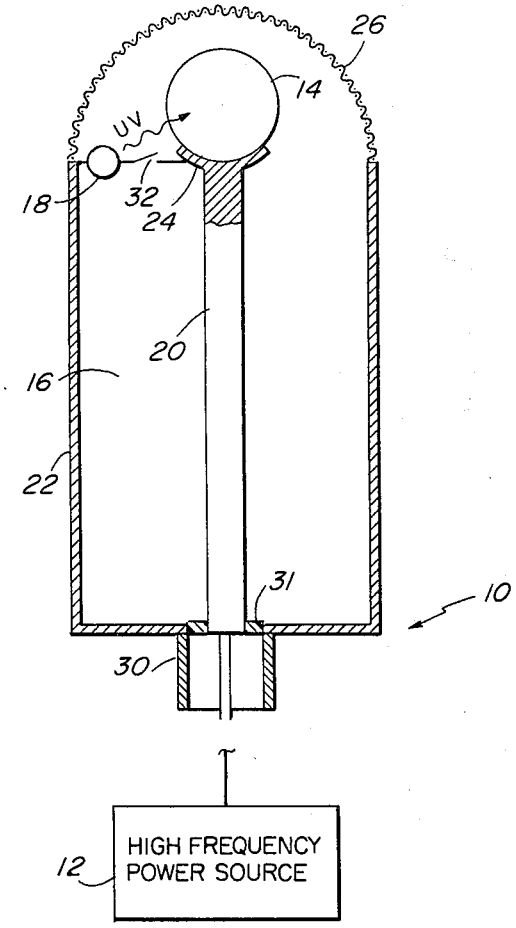
FIG. 1 is a diagram of an electrodeless light source having a starting assist device in accordance with the present invention.

In an exemplary embodiment of the present invention as illustrated in FIG. 1, a light source represented generally by the reference numeral 10 includes a source 12 of power at a high frequency, an electrodeless lamp 14, a termination fixture 16, and a source 18 of ultraviolet light. As used herein, the term high frequency is intended to include frequencies ranging from 100 MHz to 300 GHz. Preferably, the frequency is in the ISM band which ranges from 902 to 928 megahertz. The electrodeless lamp 14 has an envelope made of a light transmitting substance and a volatile fill material disposed within the envelope, the fill material emitting visible light upon breakdown and excitation. One suitable lamp composition is 9.1 mg of mercury and 10 torr of argon enclosed within a quartz sphere having a 15 MM inner diameter.

The termination fixture 16 includes an inner conductor 20 and an outer conductor 22 which is disposed around the inner conductor 20. The lamp 14 is positioned at the end of the inner conductor as shown in FIG. 1 such that when a high frequency power is applied to the fixture, the electric field that is generated between the ends of the conductors initiates breakdown and excitation of the fill material in the lamp. The end of the inner conductor may be formed with a lamp holding element 24. Preferably, a dome-shaped element 26 is provided around the end of the outer conductor 22. The lower ends of the conductors 20 and 22 are joined to an input power connector 30. A non-conductive support member 31 may be positioned between the conductors.

In accordance with the present invention, the source 18 of light having an effective amount of radiation at an ultraviolet wavelength is associated with the fixture such that the radiation provides free photoelectrons within the primary lamp 14 and excites the fill material within thereby starting the electrodeless lamp 14. The basic idea involves placing a source of light rich in UV near the electrodeless lamp 14. Preferably, the UV source is powered by the same power source which powers the electrodeless lamp. If this source is placed inside the fixture, a dome 26 which does not pass UV may be used on the fixture. This is advantageous when the electrodeless discharge is used as a visible light source.

Preferably, the UV source is a low pressure mercury discharge. Such a discharge provides 254 nm radiation which efficiently excites by resonance absorption, ground state $1_{S_0}$ mercury atoms in the electrodeless lamp to the $3_{P_0}$ state, and when 185 nm radiation is present, the $1_{P_1}$ state is likewise excited. These states are only 5.5 eV and 3.7 eV, respectively, below the ionization potential of mercury (10.4 eV). Therefore, an electrodeless lamp which uses mercury as a fill material may be advantageously assisted in starting by the use of such a device.

While FIG. 1 shows the UV source 18 disposed between the conductors of the fixture, it is also possible to build a UV source externally to the fixture wherein the ultraviolet radiation may be directed through a quartz window in the outer conductor of the fixture. One external UV source which may be used is an electroded glow lamp such as illustrated in FIG. 4; one suitable electroded glow lamp is Sylvania Germicidal type 85T5 and type B.

In FIG. 1 a switch, such as a bimetallic switch, 32 or a reactive circuit element is preferably connected in series with the UV source 18 to turn off the source after the electrodeless lamp starts.

Figure 2:
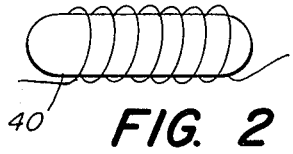
FIG. 2 is a view of an induction glow lamp which may be used as the starting assist device in FIG. 1.
Figure 3:
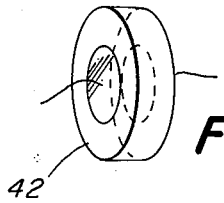
FIG. 3 is a view of a capacitive glow lamp which may be used as the starting assist device in FIG. 1.
Figure 4:
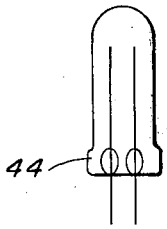
FIG. 4 is a view of an electroded glow lamp which may be used as the starting device in FIG. 1.

FIGS. 2 through 4 illustrate some types of glow discharge lamps that may be used for the UV source 18 in FIG. 1. These lamps may be filled with a Penning mixture of argon (approximately 10 torr) and mercury. Suitable glow lamps 18 include an inductively coupled glow lamp 40 in FIG. 3, a capacitively coupled glow lamp 42 in FIG. 4 and an electroded glow lamp 44 in FIG. 4. Where the UV source is located externally to the termination fixture, an external power (not shown) may be used for exciting the UV source 18. When the glow lamp 40 is used, the inductive coil itself comprises the switch 32.

Figure 5:
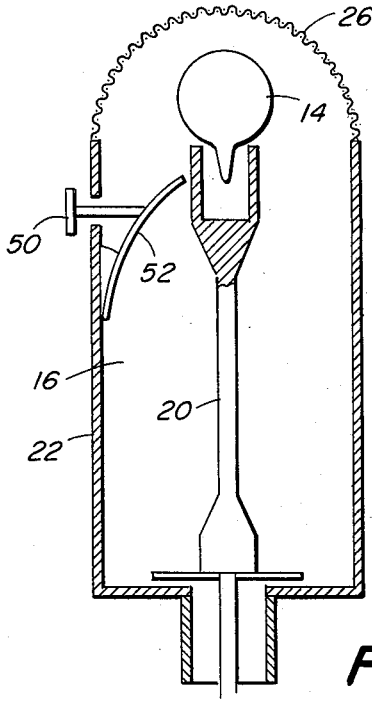
FIG. 5 is a view of a light source having a spark generating device for starting the electrodeless lamp.

FIG. 5 illustrates an alternative embodiment of the UV source in accordance with the present invention. In this embodiment an electrical discharge in air is provided for generating the source of ultraviolet radiation. The discharge or spark may be generated internally to the fixture, as shown in FIG. 5, or externally to the fixture. In the latter case, a quartz window (not shown) may be provided in the outer conductor for transmitting the radiation from the spark to the lamp 14 within the fixture. The spark starting technique has the advantage that it requires minimal fabrication and can easily rely on the primary lamp power supply for excitation. Also, the configuration and position of the element are less critical. In FIG. 5, the spark starter includes a non-conducting probe 50 to push the end of a spring wire 52, which is attached to the inner wall of the outer conductor, into contact with the inner conductor 20. When the probe 50 is slowly released, a microwave spark travels between the end of the spring wire 52 and the outer conductor 22 until the distance becomes too great to support a discharge. This spark in the atmosphere of the fixture is the UV source which assists lamp starting. Preferably, the wire 52 has a 30 mil diameter and is made of tungsten; also the inner conductor 20 is preferably made of either brass or stainless steel.

The embodiments of the present invention are intended to be merely exemplary and those skilled in the art shall be able to make numerous variations and modifications of them without departing from the spirit and scope of the present invention. All such variations and modifications are intended to be within the scope of the present invention as defined by the appended claims.

We claim:

1. A light source including, a. a source of power at a high frequency ranging from 100 MHz to 300 GHz, b. an electrodeless lamp having an envelope made of a light transmitting substance and a volatile fill material disposed within the envelope, the fill material emitting visible light upon breakdown and excitation, c. a termination fixture coupled to the source, the fixture including an inner conductor and an outer conductor disposed around the inner conductor, the lamp being positioned at the end of the conductors so that when high frequency power is applied to the fixture, breakdown and excitation of the lamp is initiated, and d. an ultraviolet light source associated with the fixture such that the UV radiation excites the fill material within the electrodeless lamp causing starting of the electrodeless lamp, the ultraviolet light source being located in the region between the conductors and being electrically connected across the conductors in the fixture so that the ultraviolet light source is powered by the high frequency source and further including means for disconnecting power to the ultraviolet light source after the lamp is started.

2. The light source according to claim 1, wherein the ultraviolet source includes an inductively coupled glow lamp connected across the conductors so that the ultraviolet light source is powered by the high frequency power source.

3. The light source according to claim 1, wherein the ultraviolet source includes a capacitively coupled glow lamp connected across the conductors so that the ultraviolet light source is powered by the high frequency power source.

4. The source according to claim 1, wherein the ultraviolet source includes an electroded glow lamp connected across the conductors so that the ultraviolet light source is powered by the high frequency power source.

5. The light source according to claim 1, wherein the ultraviolet source includes means for creating a microwave spark in the vicinity of the lamp.

6. The light source according to claim 5 wherein the microwave spark creating means includes a conductive spring wire affixed at one end to the inside wall of the outer conductor and a non-conducting probe located in an aperture formed in the outer conductor, the probe being in contact with the spring wire and adapted to be inserted further into the aperture to cause the wire to contact the inner conductor, the wire causing a spark producing ultraviolet radiation when the wire is moved out of contact with the inner conductor.

7. The light source according to claim 6, wherein the wire is made of tungsten.

8. The light source according to claim 1, wherein the power disconnecting means includes a bimetallic switch in series with the ultraviolet light source, the switch opening in response to heat.

* * * * *

PO-1050
(5/69)

UNITED STATES PATENT OFFICE
CERTIFICATE OF CORRECTION

Patent No. 3,997,816 Dated December 14, 1976

Inventor(s) Paul Osborne Haugsjaa et al.

It is certified that error appears in the above-identified patent and that said Letters Patent are hereby corrected as shown below:

Column 1, line 44, delete "stud" and substitute therefor --stub--;

Column 3, line 39, delete "$3_{P_0}$" and substitute therefor --$3_{P_1}$--;

Column 3, line 64, delete "FIG. 3" and substitute therefor --FIG. 2--;

Column 3, line 65, delete "FIG. 4" and substitute therefor --FIG. 3--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*